US008181343B2

(12) United States Patent
Martauz et al.

(10) Patent No.: US 8,181,343 B2
(45) **Date of Patent: *May 22, 2012**

(54) SEALED CRIMP CONNECTION METHODS

(75) Inventors: Francis D. Martauz, Canfield, OH (US); Kurt P. Seifert, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/883,838

(22) Filed: Sep. 16, 2010

(65) Prior Publication Data

US 2011/0083324 A1 Apr. 14, 2011

Related U.S. Application Data

(63) Continuation-in-part of application No. 12/582,158, filed on Oct. 20, 2009, now Pat. No. 7,954,235, and a continuation-in-part of application No. 12/575,689, filed on Oct. 8, 2009, now Pat. No. 7,905,755.

(51) Int. Cl.
*H01R 43/04* (2006.01)

(52) U.S. Cl. ..... 29/863; 29/855; 29/857; 29/858; 174/84 C; 438/86; 438/203

(58) Field of Classification Search ..... 29/855, 29/857, 858, 863; 174/84 C; 439/86, 203; 438/86, 203
See application file for complete search history.

(56) References Cited

U.S. PATENT DOCUMENTS 7,954,235 B2 * 6/2011 Martauz et al. ..... 29/855
2010/0084159 A1 4/2010 Drew et al.

* cited by examiner

*Primary Examiner* — Carl Arbes
(74) *Attorney, Agent, or Firm* — Paul W. Thiede

(57) ABSTRACT

Methods of making a sealed crimp connection attaching a terminal to a wire conductor are provided. A layer of fluid conformal coating is applied to overlie a terminal and underlie at least a lead of the wire conductor upon at least the lead being received into the terminal. The terminal, the fluid layer, and at least the lead of the wire conductor are crimped to form the crimp connection. Fluid conformal coating is displaced where an abutting surface of the terminal makes contact with at least the lead of the wire conductor. The fluid conformal coating is cured to a non-fluid state. The fluid conformal coating may be formed of an acrylated urethane material that may provide an increased pull force and a low crimp resistance in the crimp connection. The crimp connection may be constructed using a manufacturing process on an automated assembly line.

20 Claims, 12 Drawing Sheets

SEALED CRIMP CONNECTION METHODS

CROSS-REFERENCE TO CLAIM OF PRIORITY

This application is a continuation-in-part of U.S. application Ser. No. 12/582,158 filed 20 Oct. 2009, which is a continuation-in-part of U.S. application Ser. No. 12/575,689 filed on 8 Oct. 2009, which claims priority to U.S. Provisional Application U.S. Ser. No. 61/243,650.

TECHNICAL FIELD

The invention relates to a connection between a terminal and a wire conductor.

BACKGROUND OF INVENTION

Referring to FIG. 1, it is known to apply a sealant to a lead of the wire conductor (1) having wire strands (2) and crimp the sealed lead (3) to the core wings (4) of a terminal (5) and attach the terminal (5) to the wire conductor (1) that affords protection against contaminants that may negatively affect the electrical and mechanical operating performance therein. The insulator wings (6) of the terminal (5) are crimped to the insulative cover (7) of the wire conductor (1) and are spaced apart from the core wings (4) crimped to the sealed lead (3) by a notch (8).

Terminal/wire conductor connections are common in wiring harnesses used in many industries, such as the automotive and trucking industries. Wiring harnesses provide the conduit for electrical signal transmission that support the operation of vehicular electrical systems. In the automotive industry, it is increasingly desirable to use light weight wire conductors that may assist to provide increased fuel economy for the vehicle. These lighter weight wire conductors are often connected to commercially available terminals where the wire conductors and the terminals are constructed using dissimilar materials. Thus, it remains a goal to provide protection of the connection which is the interface where these dissimilar materials meet. The protection of the connection is especially desired to retard the formation of galvanic corrosion. Galvanic corrosion may degrade the connection such that transmission of an electrical signal through the connection is prohibited. It also remains a desirable goal to provide protection to the connection while maintaining or improving the electrical and mechanical properties of the terminal/wire conductor connection.

Accordingly, there is a need for an improved sealed connection attaching a terminal to a wire conductor having robust electrical and mechanical operating performance.

SUMMARY OF THE INVENTION

One aspect of the invention is improving the protection at the terminal/wire conductor connection, or crimp connection that may further prevent the onset of galvanic corrosion in the crimp connection.

Conventional thinking in the wiring arts is that a dielectric, insulating seal material added to a crimp connection may yield an increased crimp resistance to the crimp connection, and hence, decrease the electrical performance of the crimp connection. To this end, another aspect of the invention is the discovery of a fluid conformal coating formed from an acrylic urethane material used in the construction of the crimp connection that improves the electrical and mechanical properties of the connection while also providing an effective sealing at the crimp connection. More specifically, the crimp connection using the acrylic urethane material may have a low crimp resistance over a prolonged period of time and an increased pull force in contrast to a similarly constructed crimp connection that does not contain any seal material.

Based on the desire to improve the crimp connection to retard galvanic corrosion, the discovery of the increased pull force and low crimp resistance, and in accordance to the principles of the invention, a crimp connection is made to attach a terminal to a wire conductor by forming a layer of fluid conformal coating to overlie the terminal and underlie the lead when at least the lead is received into the terminal. The lead is received into the terminal, and the terminal, the fluid layer, and at least the lead are crimped together to produce a crimp connection that attaches the terminal to the wire conductor. The fluid conformal coating in, and about the crimp connection is cured to a non-fluid state.

BRIEF DESCRIPTION OF THE DRAWINGS

This invention will be further described with reference to the accompanying drawings in which.

DETAILED DESCRIPTION

Figure 1:
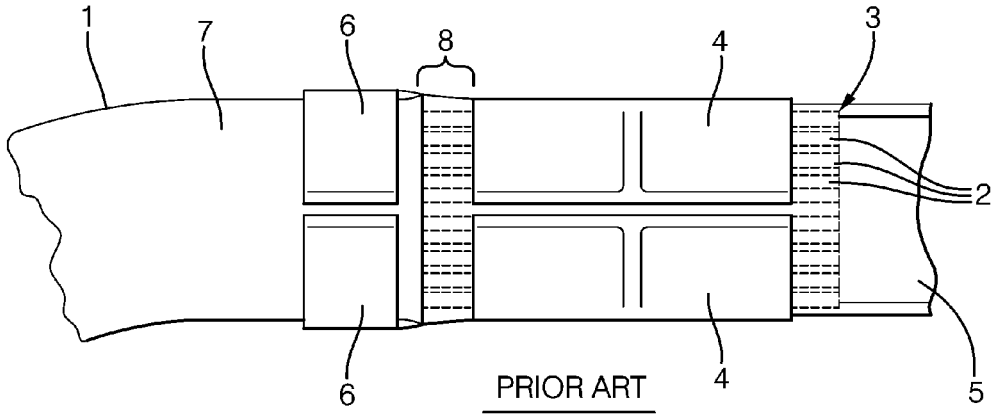
FIG. 1 is a plan view of a prior art sealed connection of a terminal attached to a wire conductor.

Referring to FIG. 2-6, a cable, or wire conductor 10 is disposed along a longitudinal axis A. Wire conductor 10 has an insulative outer cover 12 and an aluminum-based inner core 14. The term "aluminum based" as used in this document herein is defined to mean pure aluminum or an aluminum alloy where aluminum is the main metal in the alloy. Cover 12 surrounds inner core 14. Inner core 14 is constructed of a plurality of individual wire strands 16 that are bundled and twisted together. Wire strands 16 are useful to provide flexation of conductor 10 when conductor 10 is installed in a wiring application (not shown), such as during the manufacture of a vehicle. Alternately, the inner core of the wire conductor may be a single wire strand. An end portion (not shown) of cover 12 of conductor 10 is removed to expose a portion of inner core 14. Exposed portion of inner core 14 is a lead 18 of wire conductor 10. Lead 18 extends from an axial edge 20 of cover 12.

A copper-based terminal 22 includes a mating end 24, a middle portion 26, and an open wing end 28. The term "copper-based" as used in this document herein is defined to mean pure copper, or a copper alloy where copper is the main metal in the alloy. Middle portion 26 is intermediate ends 24, 28. Terminal 22 may be received into a connector (not shown) that may include a plurality of terminals (not shown) that is part of wiring harness (not shown) used in a vehicle (not shown) and the connector (not shown) may mate with a corresponding mating connector (not shown) used in the vehicle. Mating end 24 is a male mating end 30. Male mating end 30 may be received into a corresponding female receiving terminal (not shown), such as may be found in the corresponding mating connector (not shown) disposed in the vehicle (not shown), that electrically joins an electrical signal disposed on conductor 10 with another electrical circuit attached with the corresponding female receiving terminal (not shown). Alternately, male mating end 30 may be a female mating end. Middle portion 26 includes an inwardly facing tab 32 adapted to communicate with a shoulder in the connector (not shown) so that terminal 22 does not easily disengage from the connector (not shown) once tab 32 is inserted past the shoulder (not shown). Wing end 28 includes a pair of combination insulator and core wing, or elongate terminal wings 34 that extend outwardly away from terminal 22 in a direction generally perpendicular to axis A. Elongate wing 34 does not include the notch (8) in the terminal (5) as shown in the prior art of FIG. 1. The construction of elongate terminal wings 34 is different than the separate and distinct insulator wings (6) and core wings (4) as shown in the prior art of FIG. 1. Wings 34 are formed of a single unitary structure along an axial length of wing end 28 of terminal 22 and cover additional area to further encapsulate lead 18 upon being crimped to conductor 10 to form an effective mechanical connection of terminal 22 attached to conductor 10. Thus, elongate wings 34 are effective to decrease the amount of surface area of lead 18 that is exposed to open air and possible electrolyte contaminant that may facilitate undesired galvanic corrosion of lead 18 in terminal 22 when conductor 10 is crimped to terminal 22. Alternately, a single elongate wing may be employed.

Terminal 22 is chosen such that wing end 28 is sized sufficiently large to receive lead 18 and portion of outer cover 12 adjacent lead 18 to allow for an effective crimp between terminal 22 and conductor 10. Typically, a size of the terminal is related to an AWG size of the wire conductor. AWG is a term known in the wire arts as American Wire Gauge. Elongate wing 34 is effective to receive lead 18 and a portion of cover 12 adjacent lead 18 into terminal 22. A height of elongate wing 34 is sized to sufficiently wrap around and cover a substantial portion of lead 18 and a substantial portion of cover 12 adjacent lead 18 when conductor 10 is crimped to terminal 22. Wing end 28 includes an inner surface, or abutting surface 36 that engages inner core 14 of lead 18 when conductor 10 is crimped to terminal 22 to provide electrical connection between conductor 10 and terminal 22.

A fluid conformal coating 40 is disposed on an outer surface of lead 18 including an end 38 of lead 18, and over edge 20 and extending on to a portion of outer cover 12 adjacent lead 18. A seal covering 42 of fluid conformal coating 40 entombs lead 18 so as to provide a corrosion-resistant protective layer for lead 18 of conductor 10 when wire conductor 10 is received into wing end 28 of terminal 22. "Fluid" is defined as being as "being able to flow." The viscosity of coating 40 may be altered to allow coating 40 to properly flow onto wire conductor 10 so as to achieve a sufficient thickness of coating 40. Seal covering 42 of fluid coating 40 may be applied to conductor 10 by dripping, spraying, electrolytic transfer, and brush and sponge applications, and the like.

Figure 5:
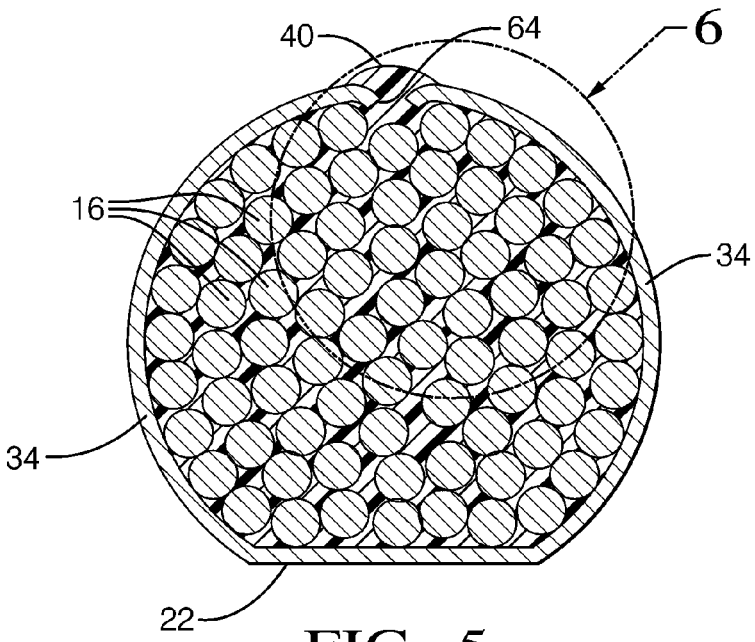
FIG. 5 is a cross section view of the crimp connection of FIG. 4, along the lines of 5-5.
Figure 6:
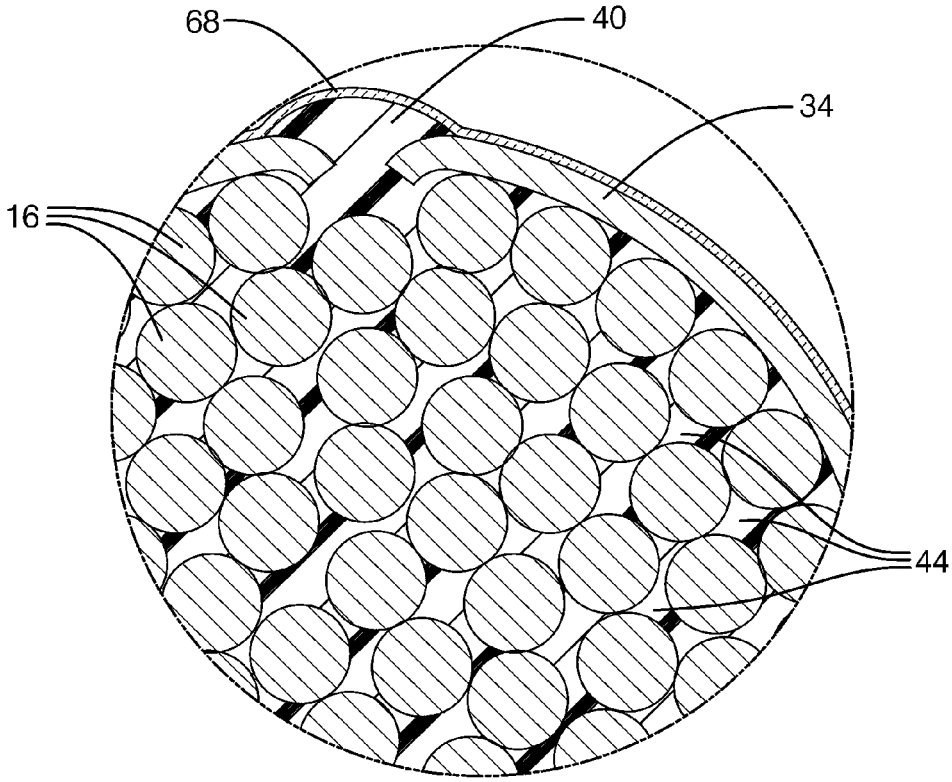
FIG. 6 is a magnified view of a portion of the crimp connection of FIG. 5.

Preferably, coating 40 is applied by dipping lead 18 and a portion of cover 12 adjacent lead 18 in bath of fluid conformal coating (not shown) and subjecting the dipped lead to applied pressure which drives the coating into voids, or interstices 44 between strands 16 of lead 18 across a cross section area of lead 18, as shown in FIGS. 5 and 6. Referring to FIG. 6, seal covering 42 is sufficiently applied to ensure a cross section of lead 18 along an axial length of lead 18 is saturated by coating 40 upon application of pressure.

As the diameter of the inner core of the wire conductor increases, a larger amount of conformal coating is needed to saturate and cover the lead of a wire conductor. When interstices 44 of wire strands 16 of lead 18 are saturated with conformal coating 40, a more complete coating of the lead 18 may increase corrosion protection for lead 18 of wire conductor 10. Alternately, the inner core may be dipped to only apply conformal coating to an outer surface of the lead of the wire conductor. Fluid conformal coating 40 may include silicon, epoxy, wax, paint, grease, and the like. Preferably, fluid coating 40 is formed from an acrylated urethane material. A suitable conformal coating made of an acrylated urethane material is commercially available from Dymax Corporation under conformal coating number 29985.

When lead 18 of conductor 10 is not received in wing end 28 of terminal 22, a connection, or crimp connection 46 between terminal 22 and conductor 10 does not occur and a mechanical and an electrical connection between terminal 22 and conductor 10 does not exist.

Figure 7:
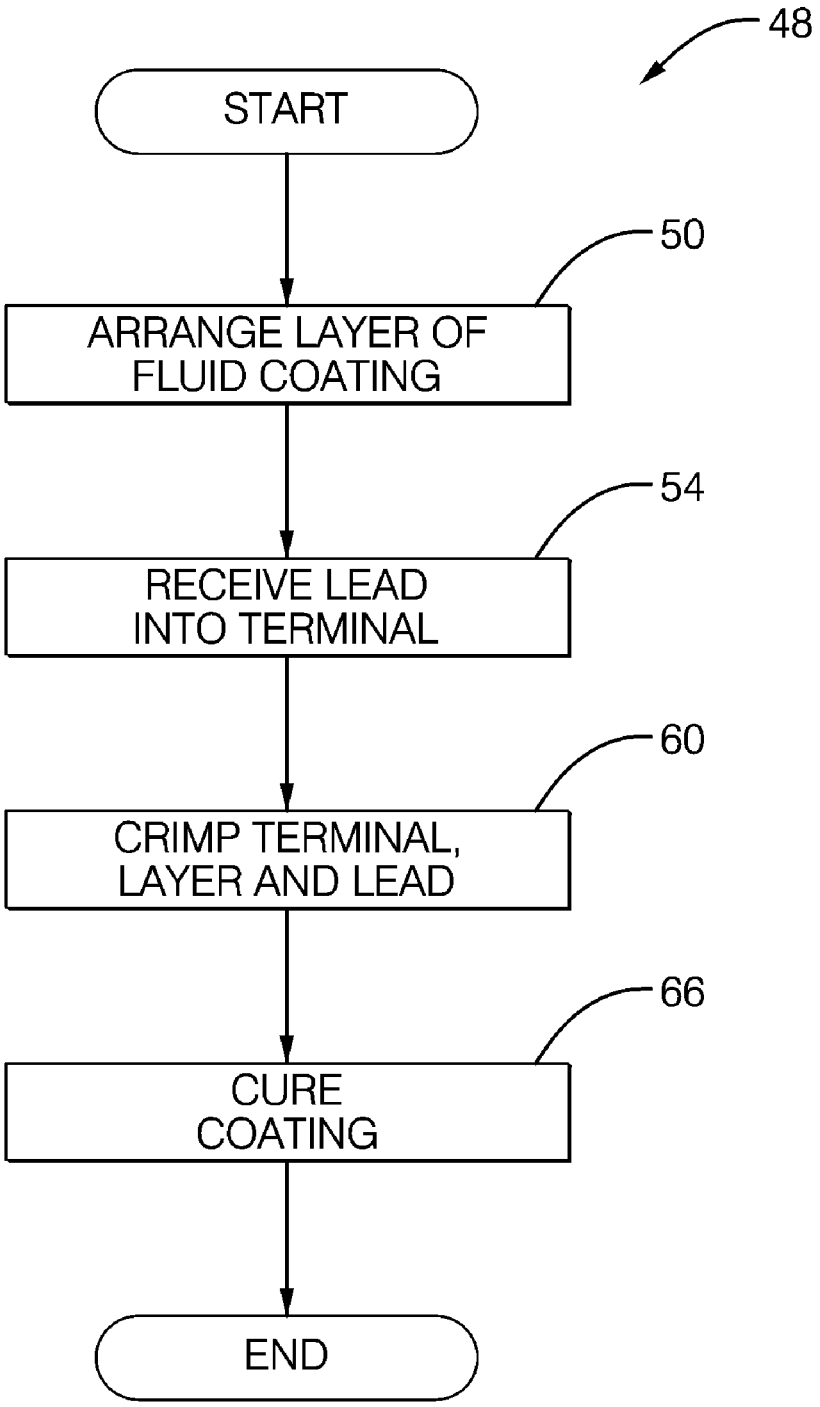
FIG. 7 is a block diagram of a method to construct the crimp connection of FIG. 3.
Figure 8A:
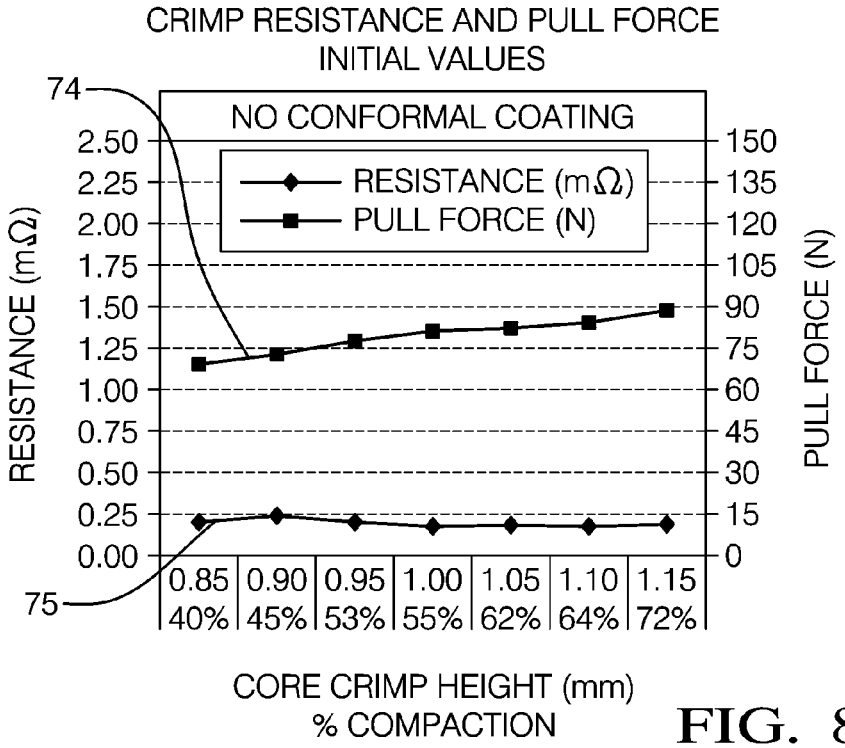
FIGS. 8A-8D are graphs illustrating the pull-force and crimp resistance for the wire conductor having a diameter of an inner core being 0.75 $mm^2$ for the crimp connection according to FIG. 3.
Figure 8B:
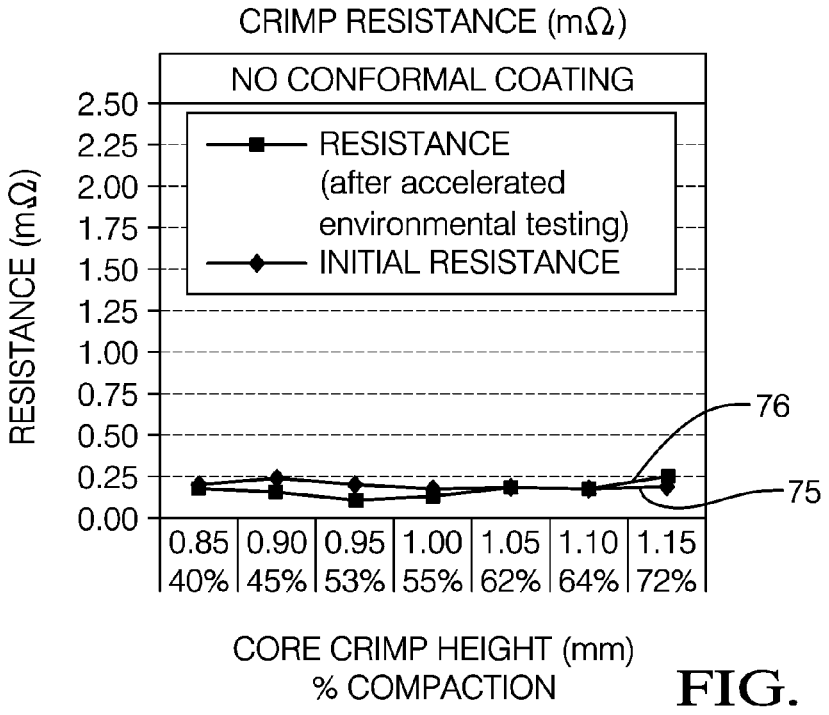
Figure 8C:
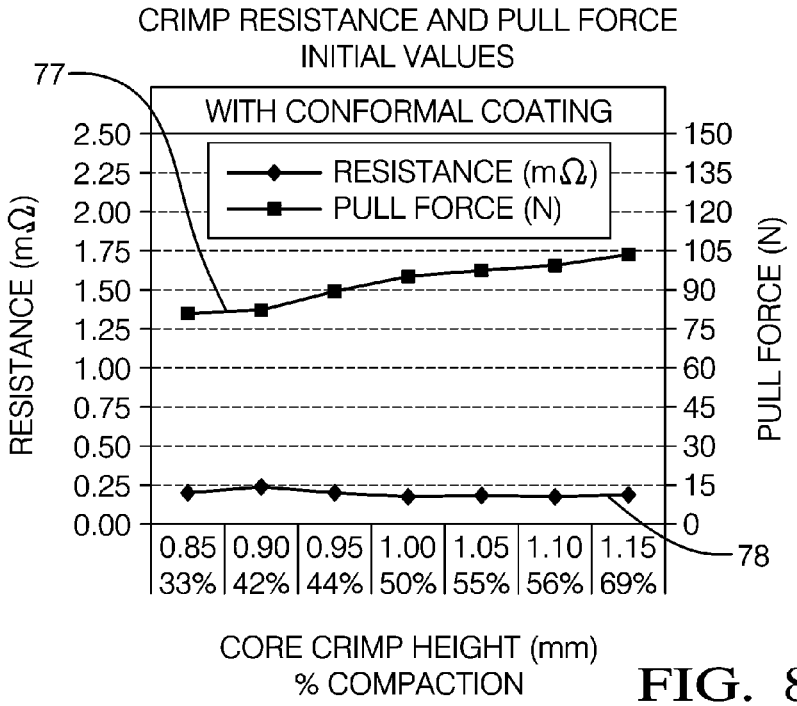
Figure 8D:
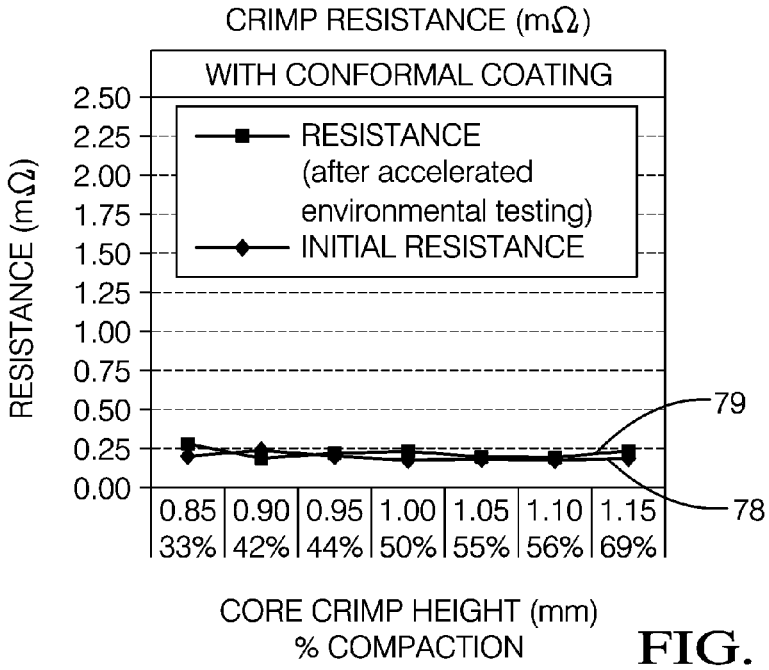
Figure 9A:
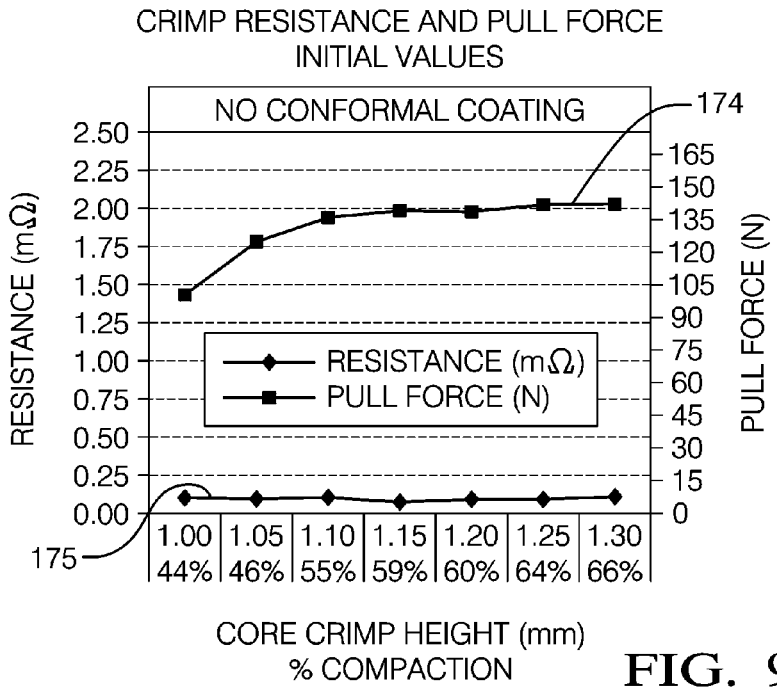
FIGS. 9A-9D are graphs illustrating the pull-force and crimp resistance for the wire conductor having a diameter of an inner core being 1.25 $mm^2$ for the crimp connection according to FIG. 3.
Figure 9B:
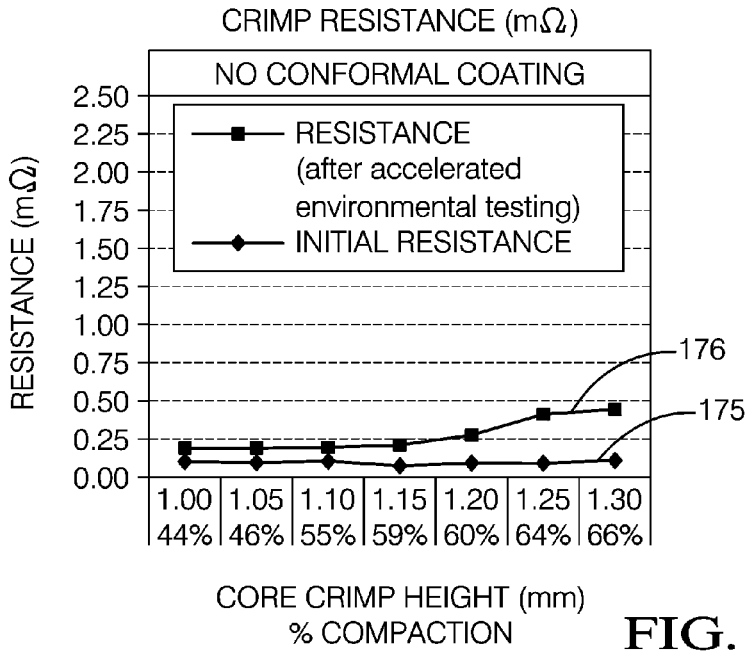
Figure 9C:
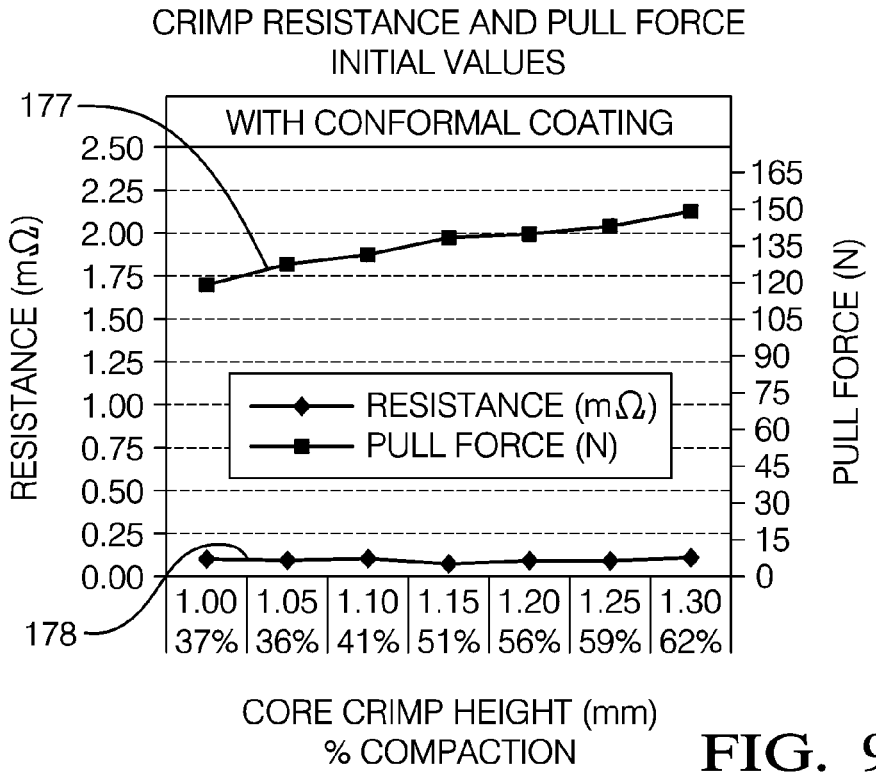
Figure 9D:
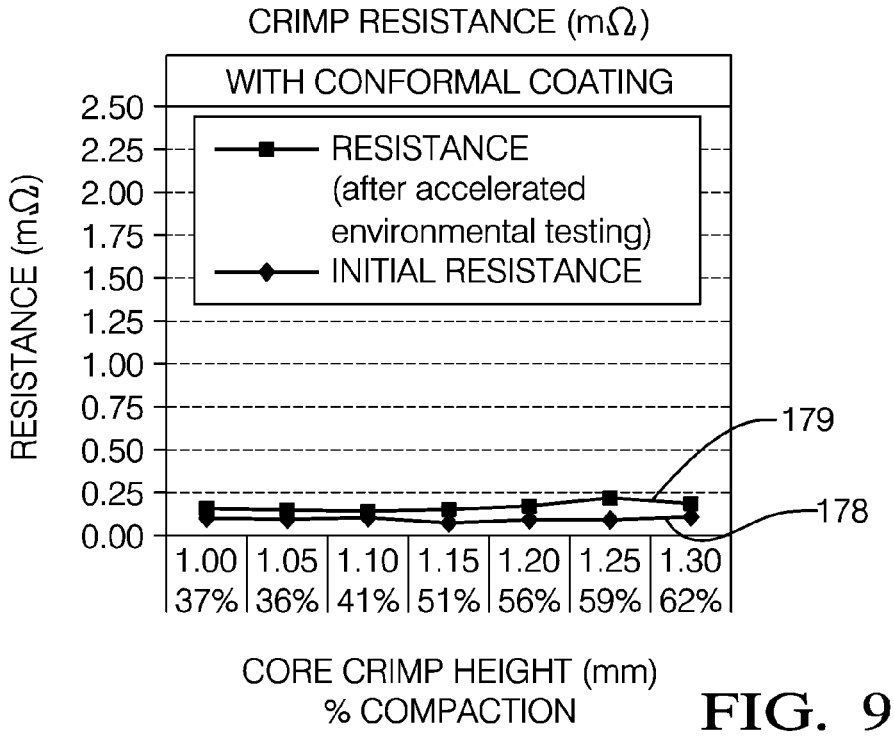
Figure 10A:
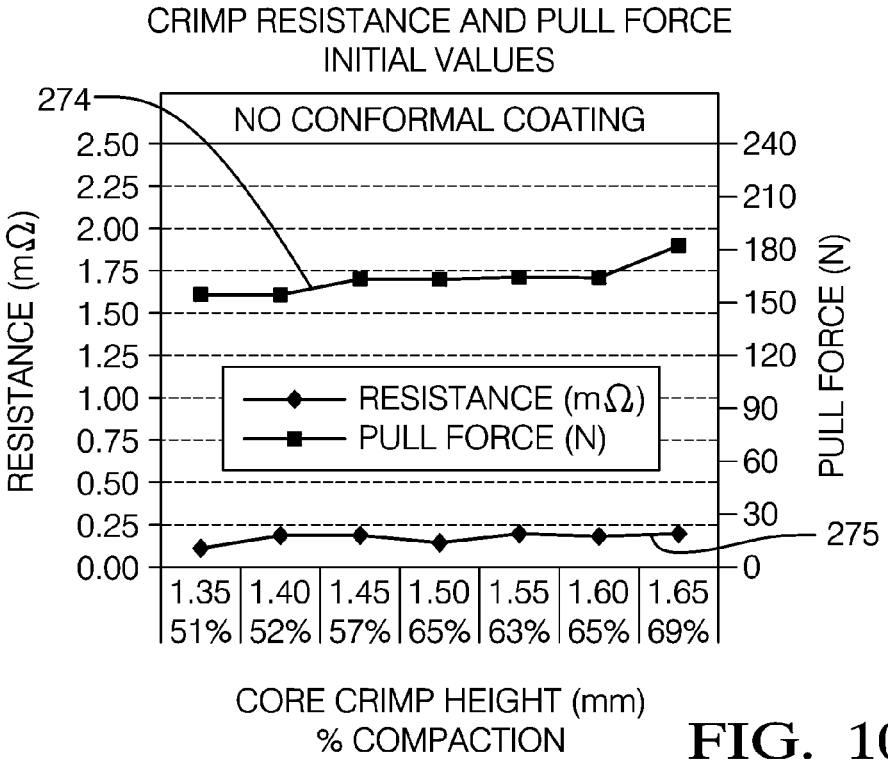
FIGS. 10A-10D are graphs illustrating the pull-force and crimp resistance for the wire conductor having a diameter of an inner core being 2.0 $mm^2$ for the crimp connection according to FIG. 3.
Figure 10B:
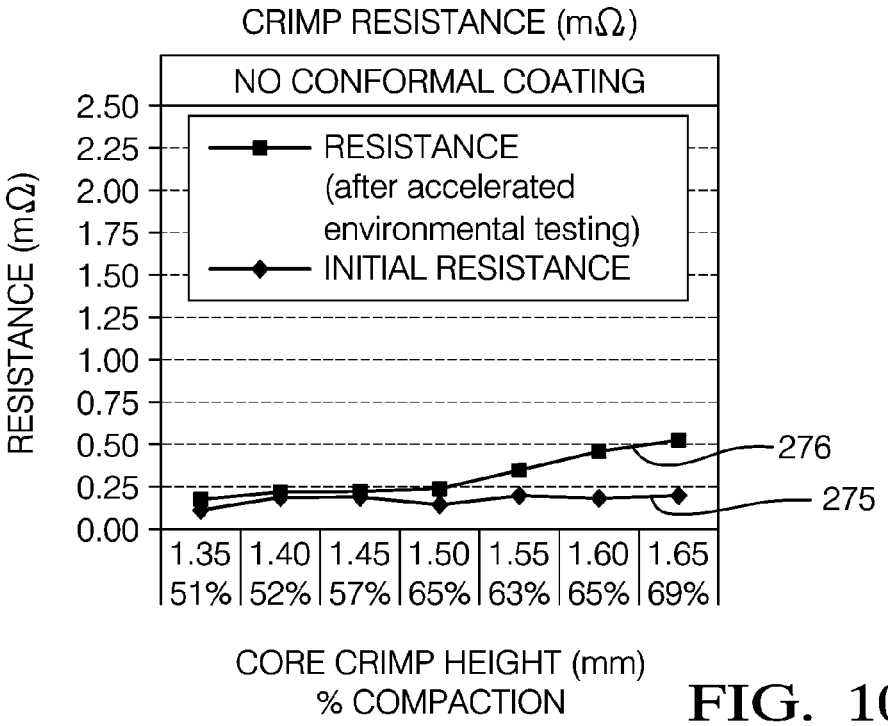
Figure 10C:
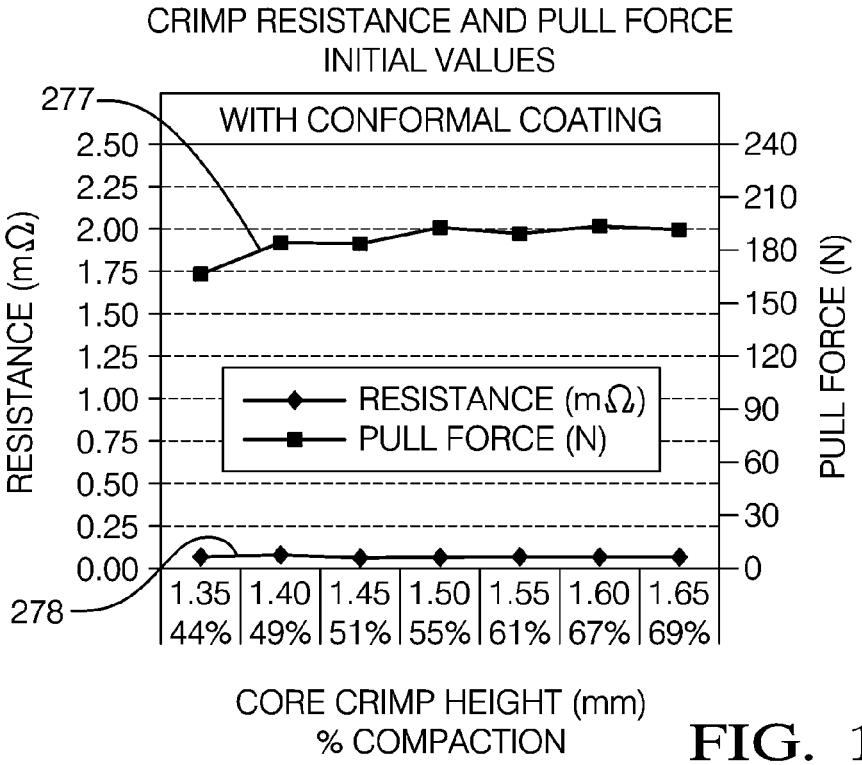
Figure 10D:
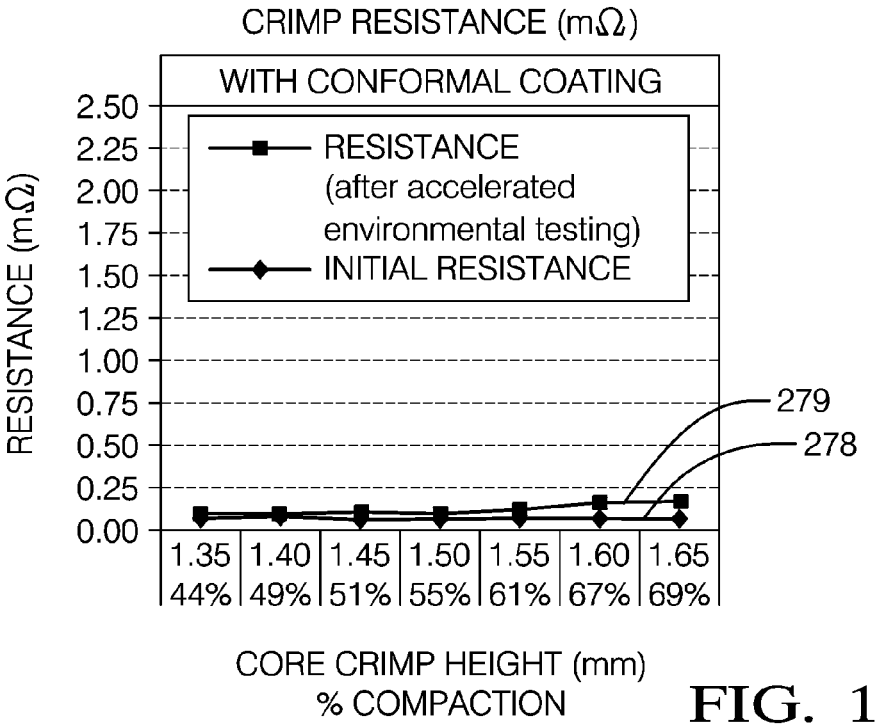
Figure 11A:
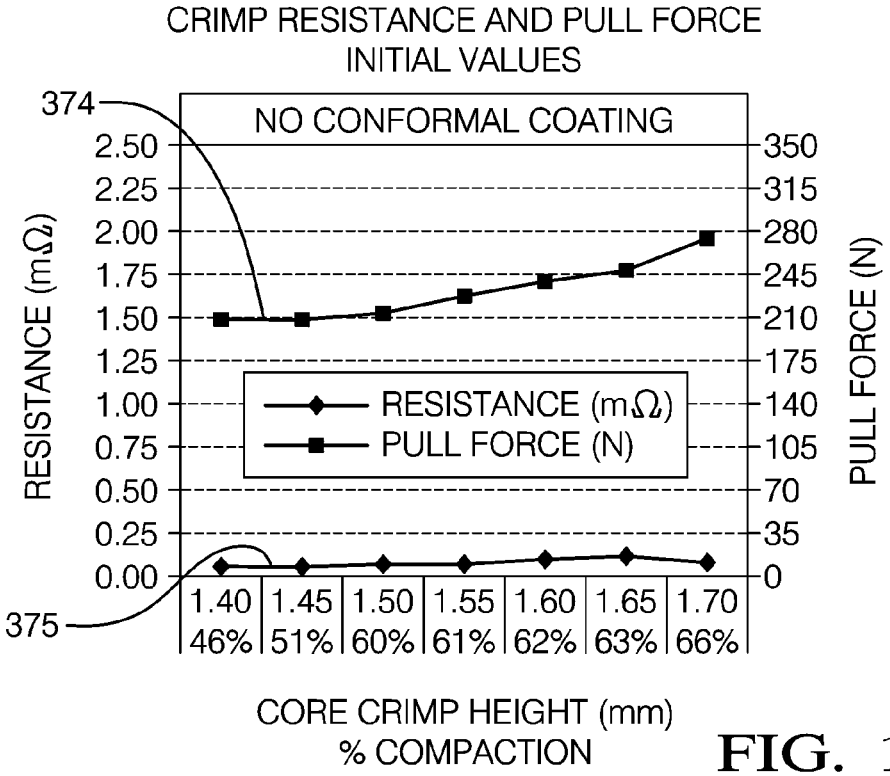
FIGS. 11A-11D are graphs illustrating the pull-force and crimp resistance for the wire conductor having a diameter of an inner core being 2.5 $mm^2$ for the crimp connection according to FIG. 3.
Figure 11B:
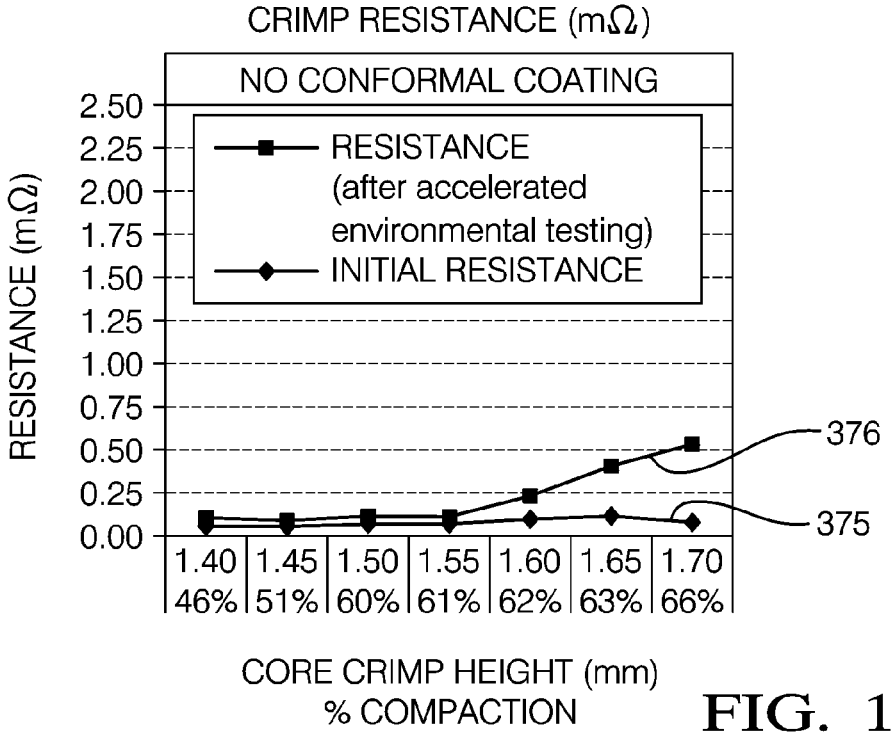
Figure 11C:
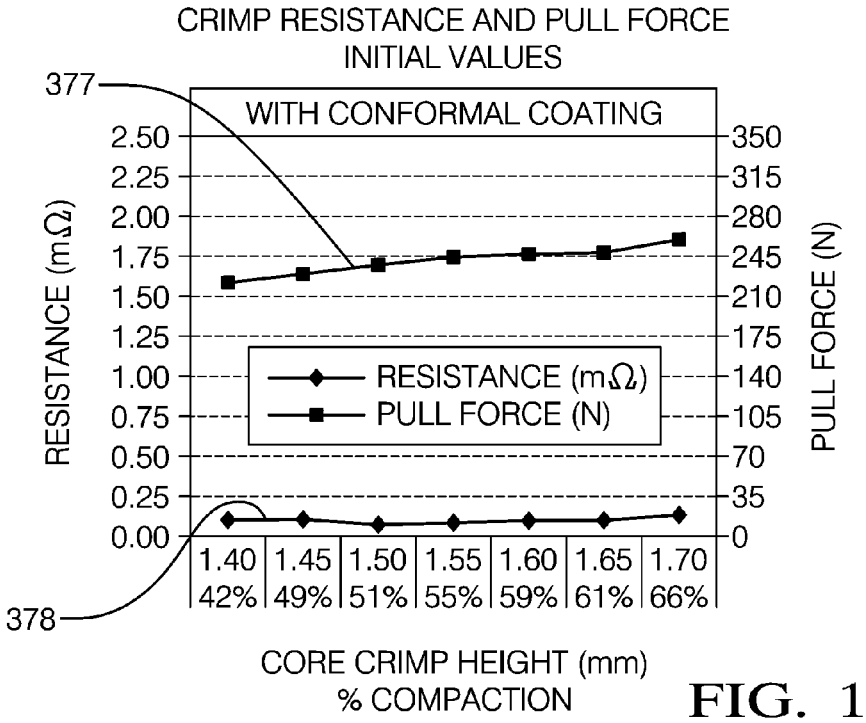
Figure 11D:
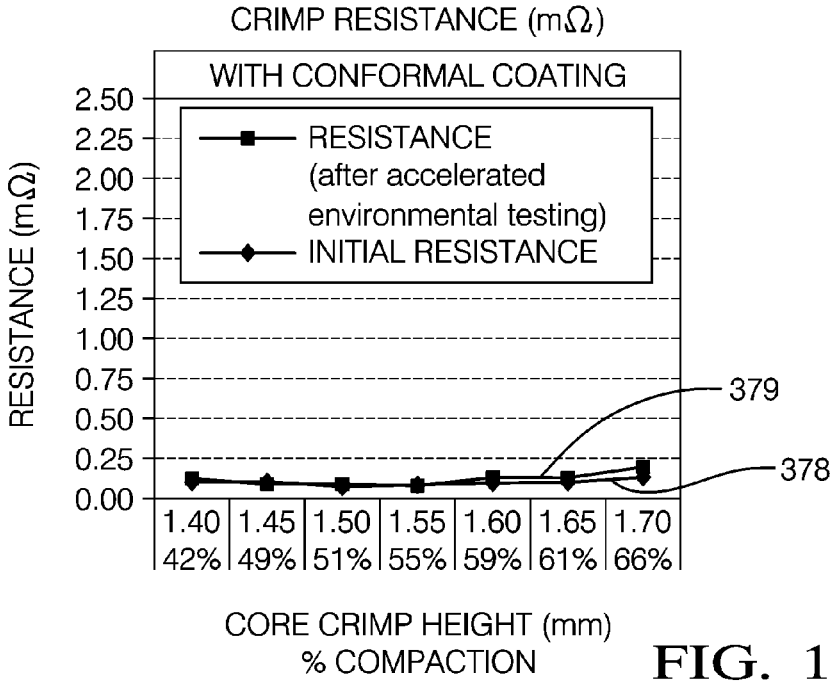

Referring to FIG. 7, a method 48 of making crimp connection 46 is provided. Construction of crimp connection 46 allows a mechanical and an electrical connection to exist between terminal 22 and conductor 10. Method 48 includes a step 50 of arranging a layer 52 of conformal coating 40 to overlie terminal 22 and underlie at least lead 18 of conductor 10. Layer 52 of conformal coating 40 in crimp connection 46 is suitable to protect lead 18 of wire conductor 10 against corrosion, moisture, dust, chemicals, and temperature extremes.

Figure 2:
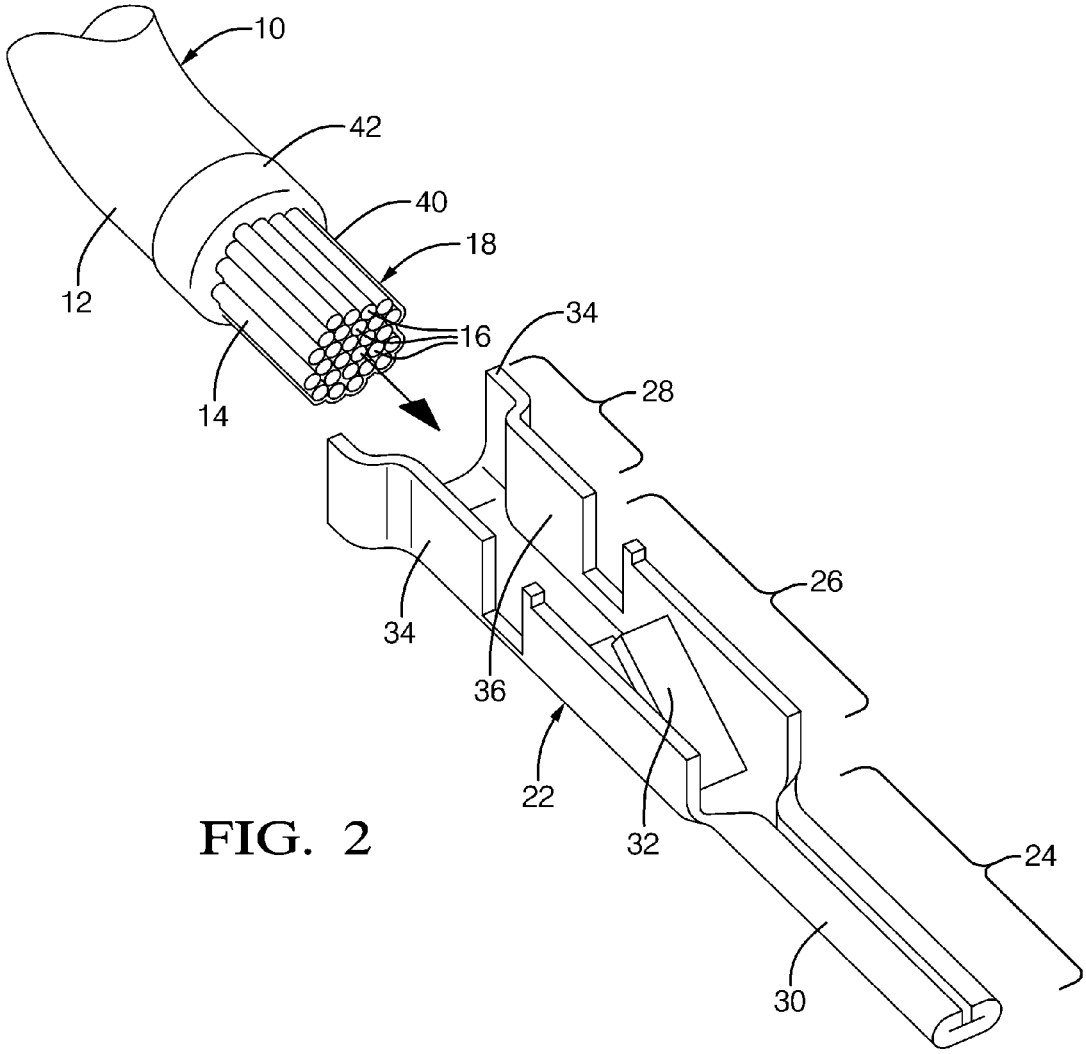
FIG. 2 is a perspective view of a terminal receiving a lead of a wire conductor and a seal covering is disposed on the lead and a portion of the outer covering adjacent the lead in accordance with the invention.

Referring to FIG. 2, conductor 10 includes seal cover 42 as previously described herein. Lead 18 is axially received into wing end 28 of terminal 22. Seal cover 42 is arranged as layer 48 on terminal 22 and extends past edge 20 onto the portion of outer covering 12 of conductor 10 which is useful to create a more hermetic seal for lead 18 and provide increased protection against the formation of galvanic corrosion in conductor 10 when crimp connection 46 is formed. For example, on wire conductor having a 14 AWG size, conformal coating 40 may extend onto covering 12 about 2 millimeters past edge 20. If conformal coating is only applied to the edge of the outer covering, the surface area of the outer covering perpendicular to axis A may not be sufficient for sealing the lead especially with flexation of the wire conductor. A further step 54 in method 48 is receiving at least lead 18 of conductor 10 in terminal 22 to allow arrangement of a layer 52 of fluid conformal coating 40 to underlie lead 18 and a portion of lead 18 adjacent lead 18, and overlie terminal 22. End 38 of lead 18 moves past a rearward edge 56 and a forward edge 58 of elongate terminal wing 34 so that conductor 10 is disposed in wing end 28. Edge 20 of outer cover 12 moves past rearward edge 58 of elongate terminal wings 34. Alternately, the end of the lead is received between the forward and the rearward edges of the elongate terminal wings.

Figure 3:
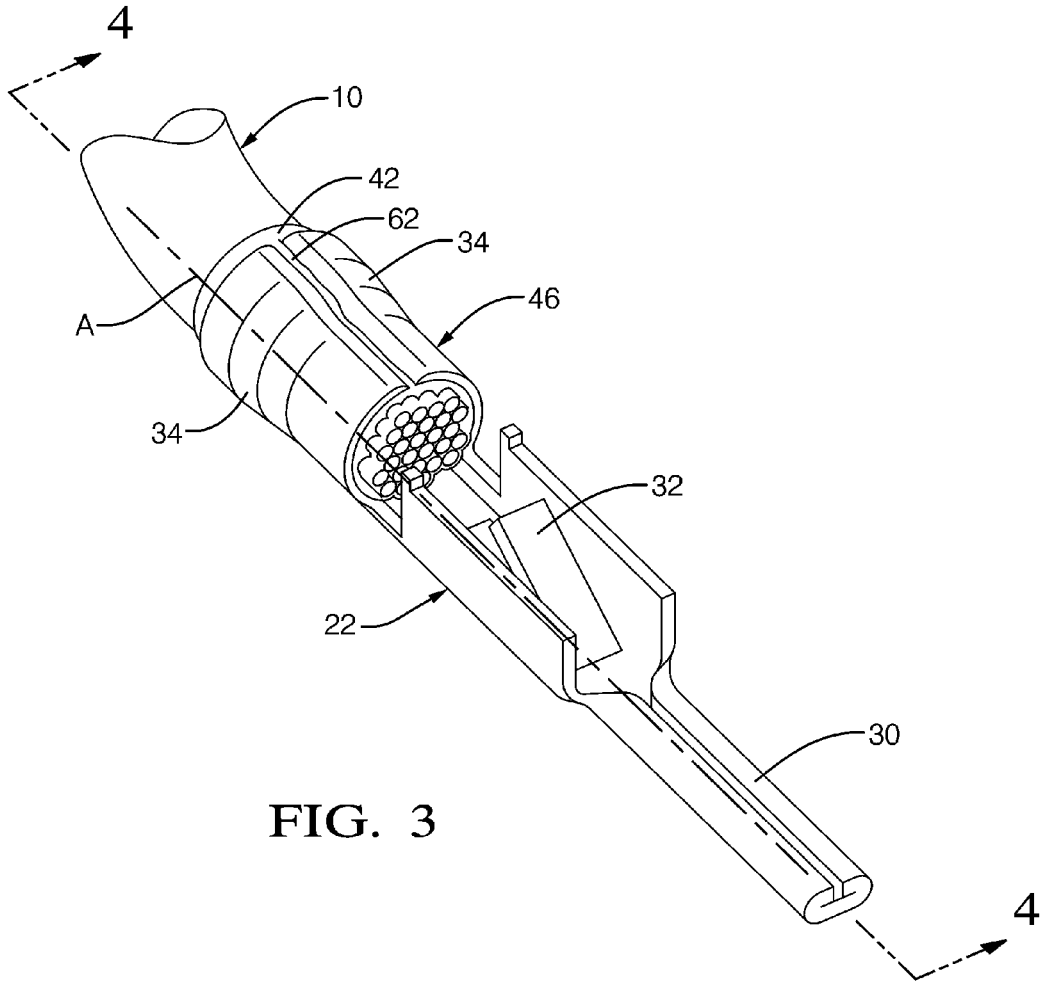
FIG. 3 is a perspective view of a crimp connection of the terminal, the conformal coating, and at least the lead of the wire conductor of FIG. 2.
Figure 4:
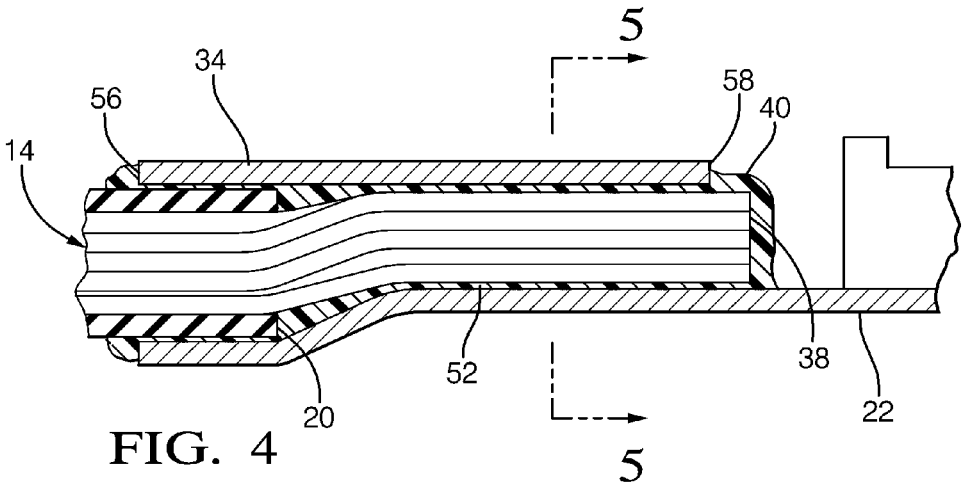
FIG. 4 is a cross section view of the crimp connection of FIG. 3, along the lines of 4-4.

Referring to FIGS. 3 and 4, another step 60 in method 48 is crimping wings 34, fluid layer 48, lead 18, and portion of outer cover 12 adjacent lead 18 together to form crimp connection 46. A crimp of a wire conductor and a terminal, as readily understood in the art, is defined as compressing or deforming a portion of the terminal around the wire conductor so as to at least make an electrical connection between the terminal and the wire conductor. A crimp of a terminal to a wire conductor may be performed by a die, or applicator press, as is known in the art. The positioning of wings 34 relative to the disposition of lead 18 is useful to ensure that wings 34 at least substantially wrap around inner core 14 of lead 18 when crimp connection 46 is formed to maximize the electrical connection between terminal 22 and lead 18 of conductor 10. Connection 46 includes wings 34 enclosing around lead 18 and a portion of cover 12 adjacent lead 18 and span over edge 20 of outer cover 12. A rearward portion of wings 34 enclose a portion of cover 12 adjacent lead 18 and a forward portion of wings 34 encloses lead 18. The crimping process moves, displaces, and pushes layer 48 of fluid coating 40 about connection 46 that further fills interstices 44 in lead 18 disposed in connection 46. Conformal coating 40 displaced during crimping may also be pushed out towards edges 56, 58 of terminal 22. Metal-to-metal contact with lead 18 may occur anywhere abutting surface 36 makes contact with lead 18 along an axial length of lead 18 in crimp connection 46. Thus, wire strands 16 may not have continuous line-to-line contact with inner surface 36 of wings 34, rather, more particularly, at a microscopic level there are a plurality of points of metal-to-metal contact of abutting surface 36 that are intermingled with a plurality of points of conformal coating 40 that are intermediate surface 36 and lead 18. Abutting surface 36 of wings 34 of terminal 22 contacts at least an outer surface of inner core 14 of lead 18 to ensure effective electrical connection between lead 18 of conductor 10 and terminal 22.

Referring to FIG. 5, with the crimp of cable 10 to terminal 22 to form crimp connection 46, a seam 62 is formed where terminal wings 34 come together. Seam 62 defines a gap 64 intermediate axial forward and rearward edges 56, 58 of wings 34. Gap 64 also allows displaced conformal coating 40 during the crimping of connection 46 to extrude out from connection 46 and form and puddle in gap 64 of seam 62. Layer 52 of fluid conformal coating 40 is sufficiently applied to cover inner core 14 at gap 64 with coating 40 along seam 62 after crimp connection 46 is formed and may fill further voids. It is important to ensure that any exposed wire strands 16 in crimp connection 46 are covered with coating 40 after crimp connection 46 is formed to prevent an entry point for galvanic corrosion that may develop in crimp connection 46. During the crimping process an enlarged rearward portion of wings 34 adjacent rearward edge 56 is formed tapering to a smaller forward portion adjacent forward edge 58 of wings 34 that is also formed that may further direct, or funnel excess fluid conformal coating toward forward edge 58 to extrude out past edge 58.

Alternately, the longitudinal edges of the terminal wings may contact each other at the seam. The compression of the wings 34 against lead 18 and cover 12 of conductor 10 is effective to mechanically secure terminal 22 to conductor 10.

After the crimping of terminal 22 onto conductor 10, layer 52 of coating 40 is cured in step 66 of method 48 to a non-fluid state. Non-fluid state of coating 40 is when coating 40 is in a solid form. Preferably, conformal coating 40 is cured by ultraviolet (UV) light (not shown) along the assembly line (not shown) that produces connection 46. The UV light may be provided, for example, by a UV lamp. Also, preferably, the UV cure is conducted after formation of crimp connection 46. If the layer of conformal coating was in solid form and then crimped to form the crimp connection, an effective seal and electrical operating performance connection 46 may not be realized.

A corrosion inhibitor 68 may be further applied after curing conformal coating 40. Inhibiter 68 is useful to fill microscopic voids (not shown) in cured conformal coating 40 disposed on lead 18 of wire conductor 10. Inhibitor 68 may also fill surface irregularities in outer insulative cover 12 of wire conductor 10, terminal 22, in an area around crimp connection 46. Corrosion inhibitor 68 may be applied using similar techniques as applying seal cover 42 to a lead of a wire conductor as previously described herein. Corrosion inhibiter 68 may be formed of a dielectric material that includes oils, waxes, and greases, and the like. Corrosion inhibitor 68 may also be applied in the manufacturing process flow on the automated assembly line along with method 48.

The steps of method 50 are successively performed in a manufacturing process flow on an automated assembly line (not shown). In this manner, the conformal coating 40 is fluidly applied and remains fluid along the assembly line (not shown) until coating 40 is cured to a non-fluid state. Preferably, fluid coating 40 is cured on the assembly line (not shown) during operation of the assembly line (not shown) to make the crimp connections. It is also preferable to not let fluid crimp connections lie at rest on the assembly line when the assembly line is idled. More preferably, fluid coating 40, including coating 40 of layer 52, is cured on the assembly line (not shown) with ultraviolet (UV) light to a solid state before coating 40 air dries to a solid state. Air drying a fluid conformal coating in a manufacturing environment is undesired as this may take a week of time or longer for the fluid conformal coating to attain the non-fluid, or solid state. Additionally, material handling of fluid crimp connections may create undesired quality issues that negatively affect the mechanical and electrical operating performance of the crimp connection. Coating 40 made from the acrylated urethane material may have tensile strength upwards of 6000 pound per square inch (PSI) when in a solid state. Dipping wire conductor 10 to apply seal covering 42 and applying pressure to seal covering as described herein, is preferably conducted on the assembly line using method 50. Preferably, fluid coating 40 having the acrylated urethane material is used on the automated assembly line also using method 50.

Using conformal coating 40 formed of an acrylated urethane material, shows an increased pull force of crimp connection 46 and a low crimp resistance of crimp connection 46. This discovery, as previously described herein, was understood by doing USCAR21 testing of crimp connection 46. USCAR21 includes testing methodologies used in the automobile industry to test the operating performance of cables, wire conductors, and the like.

Referring to FIGS. 8-11, the graphs show pull force and crimp resistance data for crimp connection 46 having a layer 52 of conformal coating 40 formed of an acrylated urethane material in contrast with similarly made crimp connection that do not contain a layer of conformal coating of any kind. For the data with coating 40 formed of an acrylated urethane material, this corresponds to inner core 14 of wire conductor 10. The set of graphs included with FIGS. 8, 9, 10, and 11 represent data for varying increasing diameter sizes of the inner core of the wire conductor. FIGS. 8A-8D illustrate data for an inner core having a diameter of about 0.75 millimeters$^2$. FIGS. 9A-9D illustrate data for an inner core having a diameter of about 1.25 millimeters$^2$. FIGS. 10A-10D illustrate data for an inner core of about 1.75 millimeters$^2$. FIGS. 11A-11D illustrate data an inner core having a diameter of about 2.0 millimeters$^2$. The crimp resistance of the crimp connection was measured before and after accelerated environmental life testing of the connection. Accelerated environmental life testing corresponds to at least 10 years of usage life for the crimp connection disposed in an environment commensurate with that found in a vehicle.

Similar elements to those in FIG. 8A-8D in the graphs of FIGS. 9-11 have reference numbers differing by 100. Graphs 8A-8B, 9A-9B, 10A-10B, and 11A-11B illustrate pull force and crimp resistance data for a crimp connection void of a conformal coating material. The respective corresponding graphs 8C-8D, 9C-9D, 10C-10D, and 11C-11D illustrate pull force and crimp resistance data for crimp connection 46 having coating 40 made of the acrylated urethane material.

Pull Force

Graph data 74, 174, 274, 374 show a pull force for a crimp connection that does not contain conformal coating for different heights of the crimp core. In contrast, graph data 77, 177, 277, 377 show a pull force for crimp connection 46 having conformal coating having the acrylated urethane material. The pull force data for corresponding crimp connection 46 amongst the various inner core wiring sizes is generally increased over the similarly made crimp connection that contains no sealing material.

While not limited to any particular theory, it is believed that the fluid layer of conformal coating having the acrylated urethane material allows the pull force to be increased because the acrylated urethane material bonds the wire strands of the lead together into a single wire strand having a larger tensile strength than the combination of the tensile strength of the individual wire and the tensile strength of the acrylate urethane material.

Crimp Resistance

Graph data 75, 175, 275, 375 show crimp resistance for a crimp connection that does not contain conformal coating for different heights of the crimp core, or connection. Graph data 76, 176, 276, 376 show crimp resistance for a crimp connection that does not contain conformal coating for different heights of the crimp connection after accelerated environmental testing. This crimp connection with no conformal coating shows a general undesired increase in the crimp resistance after the accelerated environmental life testing. An increase in crimp resistance relates to lower electrical conductivity through the crimp connection. Graph data 78, 178, 278, 378 show a crimp resistance for crimp connection 46 that contains conformal coating made of the acrylated urethane material for different heights of crimp connection 46. Graph data 79, 179, 279, 379 show a crimp resistance for a crimp connection that does not contain conformal coating for different heights of crimp connection after accelerated environmental testing. This data shows a desired, generally smaller increase in the crimp resistance measured after the accelerated environmental life testing than corresponding crimp resistance data of a crimp connection that has no conformal coating. A smaller resistance differences relates to enhanced electrical conductivity at the crimp connection.

While not limited to any particular theory, it is believed that the layer of conformal coating having the acrylated urethane material has low crimp resistance over a prolonged period of time because the metal-to-metal contact between the abutting surface of the terminal and the wire strands of the lead may not leave residual solids in the voids of the wire stands like other conformal coatings that do not have the acrylated urethane material that may interfere with the metal-to-metal contact and may result in increased resistance in the crimp connection, but not so much so as to have zero resistance in the crimp connection.

Alternately, any technique that effectively applies a layer of fluid conformal coating disposed intermediate the terminal and the lead of the wire conductor when the lead is received in the terminal may be used. For example, conformal coating may be applied to the terminal which arranges the layer to overlie the terminal and underlie at least the lead of the wire conductor. Conformal coating may be applied to the terminal by similar techniques used to apply conformal coating to the wire. Another example may include painting the fluid conformal coating on either the lead or the terminal in contact with the lead using a paint brush.

Still yet alternately, the conformal coating may be applied to both the terminal and the lead before the crimp connection is formed.

While the preferred embodiment of this invention is for an interface between to two dissimilar metals as described herein, a further alternate embodiment may include a terminal and lead made from similar or identical metals, such as pure copper or copper alloy materials. For example, the wire conductor may be made of an aluminum material and the terminal may also be made of an aluminum material.

Still yet alternately, the layer of conformal coating may be applied between a lead of a wire conductor of any diameter size connected to an associated terminal.

Applying a layer of fluid conformal coating and crimping this fluid layer to form a crimp connection provides a robust crimp connection connecting a terminal to a wire conductor. This robust crimp connection may keep an electrolyte such as salt water, from penetrating and degrading the crimp connection. Applying a seal covering of fluid conformal coating on the lead and a portion of the insulative outer cover adjacent the lead to entomb the lead provides a more effective hermetic seal of the lead and greater confidence that the lead is sealed against contaminants that may penetrate the crimp connection. Exposing the fluid seal covering on the lead to applied pressure drives the seal covering into the interstices of the wire strands of the lead that provides even greater structural sealing for the entire crimp connection. The displacement of the fluid conformal coating during crimping to form the crimp connection also further enhances the structural sealing of the lead and provides for a sealed electrical interface and contact between the terminal and lead. The elongate terminal wings further reduce exposure of the lead to the containments that may otherwise increase risk of undesired galvanic corrosion. A gap in the seam of the crimped elongate wings and the open areas at the forward and rearward edges of the elongate terminal wings provide an outlet for displaced fluid conformal coating when the terminal is crimped to the wire conductor. Extra thickness of conformal coating at these locations provides even further protection to keep contaminants from penetrating the crimp connection. Using a conformal coating having an acrylated urethane coating may provide the mechanical and electrical benefits of an increased pull force and a low crimp resistance of the connection over a prolonged period of time where the prolonged period of time is at least the projected service life of the crimp connection. In the automotive industry this may be at least 10 years of projected service life. Applying a corrosion inhibiter after curing the conformal coating to the crimp connection and the elements associated with the crimp connection may fill voids and irregularties that have developed in the cured, exposed conformal coating or other elements of the crimp connection to make a further contribution to prevent galvanic corrosion from exploiting the crimp connection.

Other variations and modifications are possible without departing from the scope and spirit of the present invention as defined by the appended claims.

While this invention has been described in terms of the preferred embodiment thereof, it is not intended to be so limited, but rather only to the extent set forth in the claims that follow.

We claim:

1. A method of making a crimp connection attaching a terminal to a wire conductor, the wire conductor including an inner core and an insulative outer cover surrounding the inner core, a portion of the outer cover at an end of the wire conductor being removed to define a lead of the inner core axially extending away from an edge of the outer cover, and the terminal adapted to receive at least the lead of the wire conductor, said method comprising:

arranging a layer of fluid conformal coating so that the layer is overlying the terminal and underlying at least the lead of the wire conductor upon at least the lead of the wire conductor being received into the terminal;

receiving at least the lead of the wire conductor into the terminal;

crimping the terminal, the layer of the fluid conformal coating, and at least the lead of the wire conductor to produce the crimp connection such that the layer of the fluid conformal coating is displaced in the crimp connection at least where an abutting surface of the terminal makes contact with at least the lead of the wire conductor; and curing the fluid conformal coating to a non-fluid state in the crimp connection and the area surrounding the crimp connection thereabout.

2. The method according to claim 1, wherein the steps in the method of claim 1 are performed in the order recited.

3. The method according to claim 1, wherein the layer of fluid conformal coating comprises an acrylated urethane material.

4. The method according to claim 3, wherein using the acrylated urethane material increases a pull force of the wire conductor and the terminal at the crimp connection.

5. The method according to claim 4, wherein the steps in the method are carried out using a manufacturing process on an automated assembly line.

6. The method according to claim 3, wherein using the acrylated urethane material provides a crimp resistance of the wire conductor and the terminal at the crimp connection that remains low over a prolonged period of time.

7. The method according to claim 6, wherein the prolonged period of time comprises at least 10 years.

8. The method according to claim 6, wherein the steps in the method are carried out using a manufacturing process flow on an automated assembly line.

9. The method according to claim 1, wherein the arranging step further includes, applying the layer of fluid conformal coating to surround the lead and surround a portion of the insulative outer cover of the wire conductor adjacent the lead to form a seal covering of the wire conductor so that the seal covering entombs the lead.

10. The method according to claim 9, wherein the inner core of the wire conductor includes wire strands and the applying step further includes, applying pressure to the lead of the wire conductor so as to drive the layer of fluid conformal coating into the interstices disposed intermediate the wire strands of the lead inbound an outer surface of the lead along at least a length of the lead thereby saturating the lead with fluid conformal coating.

11. The method according to claim 10, wherein the steps in the method are carried out using a manufacturing process flow on an automated assembly line.

12. The method according to claim 1, wherein the arranging step further includes the substeps of, applying the layer of fluid conformal coating to surround the lead and surround a portion of the insulative outer cover of the wire conductor adjacent the lead such that the fluid conformal coating surrounds the lead and the portion thereby producing a seal covering that entombs the lead, and wherein the steps of receiving and crimping further include receiving the lead such that an end of the lead moves past a rearward and a forward edge of an elongate terminal wing, and the edge of the outer cover moves past the rearward edge of the elongate terminal wing, and crimping the lead of the wire conductor, the seal covering, and the elongate terminal wing forms the crimp connection.

13. The method according to claim 1, wherein the step of curing the layer of fluid conformal coating further includes curing the layer of fluid conformal coating to the non-fluid state with ultraviolet (UV) light.

14. The method according to claim 1, further including, applying a corrosion inhibiter to fill microscopic voids in the cured conformal coating in the crimp connection and the area surrounding the crimp connection thereabout.

15. The method according to claim 1, wherein the steps in the method are carried out in a manufacturing process flow on an automated assembly line.

16. A method of making a crimp connection attaching a terminal to a wire conductor, the wire conductor including an inner core and an insulative outer cover surrounding the inner core, a portion of the outer cover at an end of the wire conductor being removed to define a lead of the inner core axially extending away from an edge of the outer cover, and the terminal adapted to receive at least the lead of the wire conductor, said method comprising:

arranging a layer of fluid conformal coating so that the layer is overlying the terminal and underlying the lead of the wire conductor and a portion of the wire conductor adjacent the lead when the lead and said adjacent portion are received into the terminal;

receiving the lead and said adjacent portion of the wire conductor in to the terminal;

crimping the terminal, the layer of the fluid conformal coating, the lead, and the adjacent portion to produce the crimp connection such that the layer of the fluid conformal coating is displaced in the crimp connection at least where an abutting surface of the terminal makes contact with the lead and said adjacent portion of the wire conductor; and curing the fluid conformal coating to a non-fluid state in the crimp connection and the area surrounding the crimp connection thereabout.

17. The method according to claim 16, wherein the step of arranging the layer of fluid conformal coating further includes, applying a seal covering to the lead and a portion of the insulative outer covering adjacent the lead; and applying a pressure to the lead to fill voids in the lead of the wire conductor, and drive the conformal coating inbound of an outer surface of the lead so that the conformal coating saturates the lead at least along a length of the lead.

18. The method according to claim 16, wherein the layer of fluid conformal coating comprises an acrylated urethane material so that a pull force of the wire conductor and the terminal at the crimp connection is increased over a prolonged period of time.

19. The method according to claim 16, wherein the layer of fluid conformal coating comprises an acrylated urethane material so that a crimp resistance of the wire conductor and the terminal at the crimp connection remains low over a prolonged period of time.

20. The method according to claim 19, wherein the prolonged period of time is at least 10 years.

* * * * *